US011414829B2

(12) United States Patent
Shokouhi

(10) Patent No.: US 11,414,829 B2
(45) Date of Patent: Aug. 16, 2022

(54) HYBRID MANHOLE COVER

(71) Applicant: NEENAH FOUNDRY COMPANY, Neenah, WI (US)

(72) Inventor: Hassan Shokouhi, Neenah, WI (US)

(73) Assignee: Neenah Foundry Company, Neenah, WI (US)

( * ) Notice: Subject to any disclaimer, the term of this patent is extended or adjusted under 35 U.S.C. 154(b) by 0 days.

(21) Appl. No.: 17/060,500

(22) Filed: Oct. 1, 2020

(65) Prior Publication Data

US 2021/0102354 A1 Apr. 8, 2021

Related U.S. Application Data

(60) Provisional application No. 62/911,624, filed on Oct. 7, 2019.

(51) Int. Cl.
*E02D 29/14* (2006.01)

(52) U.S. Cl.
CPC ..... *E02D 29/1472* (2013.01); *E02D 29/14* (2013.01)

(58) Field of Classification Search
CPC ..... E03F 5/06; E02D 29/14; E02D 29/1409; E02D 29/1427; E02D 29/1472
USPC ..... 404/25, 26; 52/19, 20
See application file for complete search history.

(56) References Cited

U.S. PATENT DOCUMENTS

| | | | | |
|---|---|---|---|---|
| 139,938 | A * | 6/1873 | Williams | |
| 599,441 | A | 2/1898 | Dorr | |
| 897,048 | A | 8/1908 | Astfalck | |
| 737,667 | A | 9/1908 | Schunck | |
| 969,881 | A | 9/1910 | Klemm | |
| 1,076,386 | A | 10/1913 | O'Day | |
| 1,458,391 | A | 6/1923 | Burton | |
| 1,541,436 | A * | 6/1925 | Reshan | E02D 29/14 210/163 |
| 1,616,298 | A | 2/1927 | Arnett | |
| 1,902,731 | A | 3/1933 | Sherman | |
| 2,113,747 | A | 3/1933 | Sherman | |
| 2,436,016 | A | 2/1948 | Myers | |

(Continued)

FOREIGN PATENT DOCUMENTS

| | | |
|---|---|---|
| DE | 28 26 082 | 6/1978 |
| EP | 0 305 245 | 3/1989 |

(Continued)

OTHER PUBLICATIONS

"Standartpark" 1 page, before Oct. 1, 2019 (Year: 2019).*
Search Report issued in Great Britain application No. GB1615654.9, dated Dec. 15, 2016.

*Primary Examiner* — Sunil Singh
(74) *Attorney, Agent, or Firm* — Foley & Lardner LLP

(57) ABSTRACT

A manhole cover includes a base with at least one opening therein to define a grate portion. A lip extends axially from the base along the outer circumference thereof, the base and the lip defining a recess. The manhole cover also comprises a composite portion comprising a composite material, the composite portion including a composite body defined by a top surface and a bottom surface. At least one aperture extends through the composite body, the top surface, and the bottom surface, the at least one aperture configured to receive at least one fastener, the at least one aperture configured to align with the at least one opening. The composite portion is configured to fit within the recess.

20 Claims, 4 Drawing Sheets

(56) References Cited

U.S. PATENT DOCUMENTS

| | | | | |
|---|---|---|---|---|
| 2,466,993 | A | 4/1949 | Lickteig | |
| 2,576,353 | A * | 11/1951 | Oscar | E03F 5/02 210/251 |
| 2,927,812 | A | 3/1960 | Smith et al. | |
| 2,987,908 | A | 6/1961 | Pelcin | |
| 3,182,581 | A | 5/1965 | Poederoyen et al. | |
| 3,530,696 | A | 9/1970 | Dunmire | |
| 3,729,771 | A | 5/1973 | Crane et al. | |
| 3,871,198 | A | 3/1975 | Miller | |
| 3,970,343 | A | 7/1976 | Horn | |
| 4,145,259 | A | 3/1979 | Leumann | |
| 4,337,005 | A | 6/1982 | Lebaron | |
| 4,461,597 | A | 7/1984 | Laurin | |
| 4,739,896 | A | 4/1988 | Moss | |
| 4,750,569 | A | 6/1988 | Flogaus | |
| 4,906,128 | A | 3/1990 | Trudel | |
| 4,925,221 | A | 5/1990 | Carmody et al. | |
| 4,928,615 | A | 5/1990 | Williams | |
| 4,973,191 | A * | 11/1990 | Dannhauser | G09F 19/22 404/25 |
| 5,211,504 | A | 5/1993 | Trudel | |
| 5,344,253 | A | 9/1994 | Sacchetti | |
| 5,360,131 | A | 11/1994 | Phillipps et al. | |
| 5,451,119 | A | 9/1995 | Hondulas | |
| 5,465,862 | A | 11/1995 | Devlin | |
| 5,525,006 | A | 6/1996 | Kilman et al. | |
| 5,533,641 | A | 7/1996 | Argandona | |
| 5,788,406 | A | 8/1998 | Hernandez | |
| 5,950,368 | A | 9/1999 | Bradford | |
| 6,125,508 | A | 10/2000 | Formenti | |
| 6,199,414 | B1 | 3/2001 | Chang | |
| 6,266,928 | B1 | 7/2001 | Argandona | |
| 6,311,433 | B1 | 11/2001 | Zdroik | |
| 6,616,370 | B1 | 9/2003 | Signorelli | |
| 6,763,967 | B2 | 7/2004 | Calder | |
| 6,764,261 | B1 | 7/2004 | Stadler | |
| 6,811,119 | B1 | 11/2004 | Petersen et al. | |
| 6,851,225 | B1 | 2/2005 | Haar et al. | |
| 6,913,297 | B2 | 7/2005 | Jackson et al. | |
| 6,951,318 | B1 | 10/2005 | Petersen et al. | |
| 7,128,496 | B2 | 10/2006 | Rogers et al. | |
| 7,223,051 | B1 | 5/2007 | Vought et al. | |
| 7,243,515 | B2 | 7/2007 | Meyer | |
| 7,484,908 | B2 | 2/2009 | Stadler | |
| 7,704,010 | B2 | 4/2010 | Nolle et al. | |
| 7,712,995 | B2 | 5/2010 | Stadler | |
| 7,798,742 | B2 | 9/2010 | Nolle et al. | |
| 7,887,252 | B1 | 2/2011 | Wang | |
| 7,891,904 | B2 | 2/2011 | Stadler | |
| 7,896,574 | B2 | 3/2011 | Nolle et al. | |
| 8,220,298 | B2 | 7/2012 | Burke et al. | |
| 8,449,216 | B2 | 5/2013 | Vrondran et al. | |
| 8,674,830 | B2 | 3/2014 | Lanham et al. | |
| 8,784,000 | B2 | 7/2014 | Reynolds et al. | |
| 8,888,400 | B2 | 11/2014 | Nolle et al. | |
| 9,127,431 | B2 | 9/2015 | Lanham et al. | |
| 9,157,212 | B2 | 10/2015 | Nolle et al. | |
| 9,340,948 | B2 | 5/2016 | Allen et al. | |
| 9,416,516 | B2 | 8/2016 | Stadler | |
| 9,771,702 | B2 | 9/2017 | Han | |
| 9,909,275 | B2 | 3/2018 | Burr | |
| 9,915,052 | B2 | 3/2018 | Shokouhi | |
| 2002/0176743 | A1* | 11/2002 | Shumlansky | E02D 29/1409 404/26 |
| 2005/0285412 | A1 | 12/2005 | Kim | |
| 2006/0255596 | A1 | 11/2006 | Yong | |
| 2009/0255183 | A1 | 10/2009 | Nolle et al. | |
| 2010/0193293 | A1 | 8/2010 | Murray et al. | |
| 2010/0281778 | A1 | 11/2010 | Loya-Morales | |
| 2011/0025074 | A1 | 2/2011 | Reznar | |
| 2011/0222964 | A1 | 9/2011 | Lacroix | |
| 2012/0020728 | A1 | 1/2012 | Royer et al. | |
| 2013/0195549 | A1 | 8/2013 | Fier | |
| 2013/0221688 | A1 | 8/2013 | Stadler | |
| 2014/0250794 | A1 | 9/2014 | Reynolds et al. | |
| 2015/0076835 | A1 | 3/2015 | Mitchell et al. | |
| 2015/0104254 | A1 | 4/2015 | Minarovic | |
| 2016/0097181 | A1 | 4/2016 | Allen et al. | |
| 2016/0289912 | A1 | 10/2016 | Smith | |
| 2016/0289913 | A1 | 10/2016 | Canney et al. | |
| 2016/0356522 | A1* | 12/2016 | Bertini | F24F 7/08 |
| 2017/0081821 | A1 | 3/2017 | Shokouhi | |
| 2019/0368154 | A1* | 12/2019 | Nunnery | G06K 19/0723 |

FOREIGN PATENT DOCUMENTS

| | | | | |
|---|---|---|---|---|
| EP | 0 737 782 | | 10/1996 | |
| EP | 0 856 611 | A1 | 8/1998 | |
| EP | 1 526 236 | | 1/2008 | |
| EP | 2 987 915 | A1 | 2/2016 | |
| FR | 2685716 | | 7/1993 | |
| JP | 2000-120096 | A | 4/2000 | |
| JP | 2004-011247 | A | 1/2004 | |
| JP | 2005-290731 | A | 10/2005 | |
| JP | 2007-224687 | A | 9/2007 | |
| JP | 2008-038542 | | 2/2008 | |
| KR | 101156757 | | 3/2011 | |
| WO | WO-9853151 | A1 * | 11/1998 | E02D 29/14 |
| WO | WO-2015/006559 | A1 | 1/2015 | |

* cited by examiner

HYBRID MANHOLE COVER

CROSS-REFERENCE TO RELATED APPLICATIONS

The present application claims priority to U.S. Provisional Application No. 62/911,624, filed Oct. 7, 2019, the entire contents of which are incorporated herein by reference.

TECHNICAL FIELD

The present disclosure relates generally to the field of manhole cover assemblies.

BACKGROUND

A manhole provides access to an underground passage or confined area. The underground passage or confined area may contain public utility equipment, such as sewer lines, storm drains, electrical and telecommunication cables, etc. A manhole cover is a removable plate that is positioned over the opening of a manhole. Manhole covers are used to prevent individuals and objects from falling into the manhole, as well as to prevent unauthorized access into the manhole.

Manhole covers are conventionally formed of cast iron, which makes them relatively inexpensive, strong, and heavy, often weighing more than 100 pounds. The weight helps to keep the covers in place when traffic passes over them, and makes it difficult for unauthorized individuals to remove the covers. To perform maintenance on public utility equipment, workers access the equipment through a manhole by removing the manhole cover.

Increasingly, manholes are being fitted with data collection and transmission devices for the purpose of sending information about the manhole operations and conditions to a central location. This allows data to be reviewed real time without sending personnel to the manhole. A conventional cast iron manhole cover, however, may prevent a signal sent from below the manhole from reaching a target destination located in a different location than the manhole.

SUMMARY

In one set of embodiments, a manhole cover includes a base with at least one space therein to define a grate portion that defines at least one opening extending therethrough. A lip extends axially from the base along an outer circumference thereof, the base and the lip defining a recess. The manhole cover also comprises a composite portion comprising a composite body including a top surface and a bottom surface. At least one aperture extends through the composite body, the top surface, and the bottom surface, the at least one aperture configured to receive at least one fastener, the at least one aperture configured to align with the at least one opening. The composite portion is configured to fit within the recess.

In another set of embodiments, a manhole cover includes a base with at least one space therein to define a grate portion. A lip extends axially from the base along an outer circumference thereof, the base and the lip defining a recess therein. A composite portion is removably coupled to the base and comprises a composite material. The composite portion includes a composite body with a top surface and a bottom surface and defines at least one aperture extending entirely therethrough. The at least one aperture is configured to receive at least one fastener configured to align with an opening in the grate portion. The composite portion is configured to fit within the recess.

In yet another set of embodiments, a manhole cover configured to couple with a manhole frame comprises a base configured to couple with the manhole frame. The base includes a grate portion defining a plurality of spaces therein, the grate portion further defining at least one opening extending therethrough. A lip extends axially from the base along an outer circumference thereof, the base and the lip defining a recess therein. A composite portion comprises a composite material and includes a composite body with a top surface and a bottom surface. At least one aperture extends through the composite body, the top surface, and the bottom surface. The at least one aperture is configured to receive at least one fastener and is configured to align with the at least one opening, and the composite portion is configured to fit within the recess.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

DETAILED DESCRIPTION

Following below are more detailed descriptions of various concepts related to, and implementations of, methods, apparatuses, and systems for covering a manhole. The various concepts introduced above and discussed in greater detail below may be implemented in any of numerous ways, as the described concepts are not limited to any particular manner of implementation. Examples of specific implementations and applications are provided primarily for illustrative purposes.

Information or data concerning the manhole contents, operation, or conditions are sometimes communicated through the use of sensors, data collectors, and transmitters wirelessly to an offsite above ground location. However, the materials (such as cast iron) used in some manholes may prevent signals from reaching areas above the manhole cover. In addition, replacing those materials with conventional materials that allow signals to pass may negatively impact the structural integrity of the manhole cover.

Figure 1:
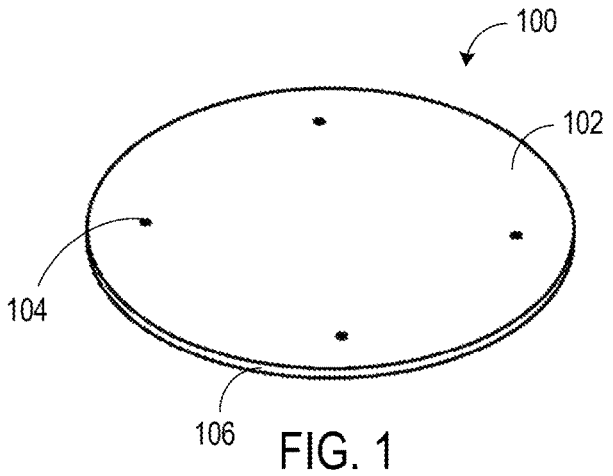
FIG. 1 is a perspective view of a reinforced plastic composite portion of a manhole cover, according to a particular embodiment.
Figure 2:
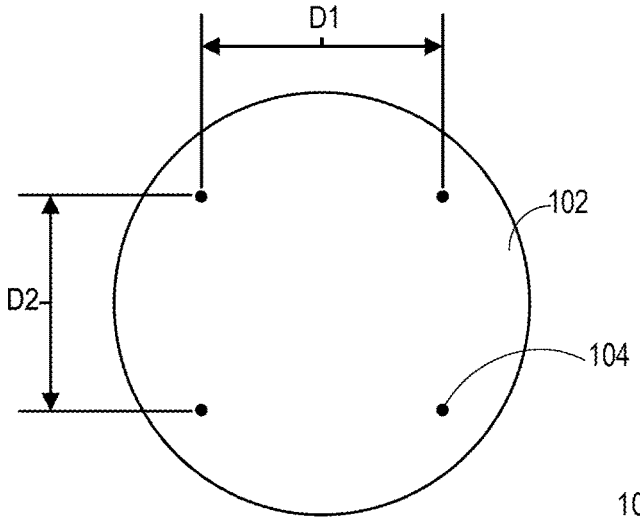
FIG. 2 is a top view of the reinforced plastic composite portion, of FIG. 1.
Figure 3:
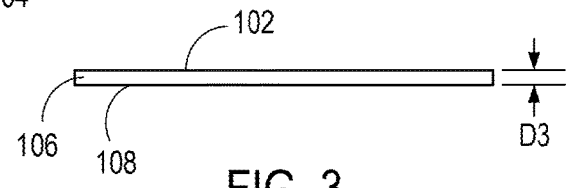
FIG. 3 is a side view of the reinforced plastic composite portion, of FIG. 1.
Figure 4:
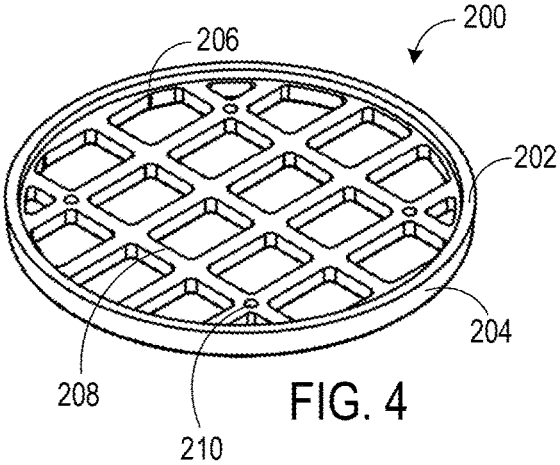
FIG. 4 is a perspective view of an example grate portion for use with the reinforced plastic composite portion of FIG. 1.
Figure 5:
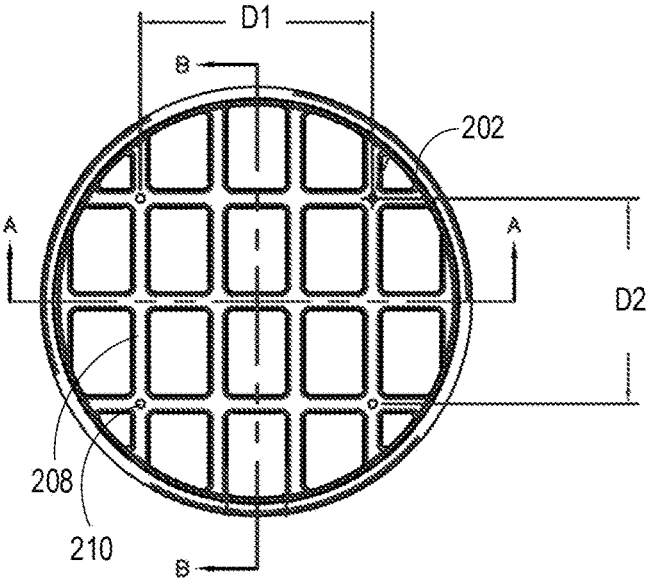
FIG. 5 is a top view of the grate portion of FIG. 4.
Figure 6:
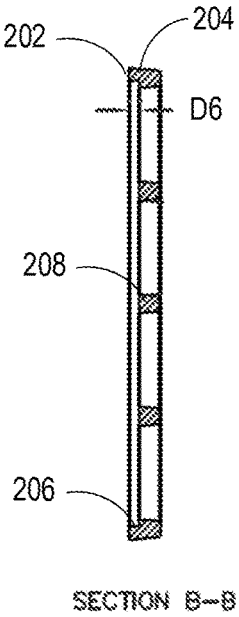
FIG. 6 is a cross-sectional view of the grate portion of FIG. 4.
Figure 7:
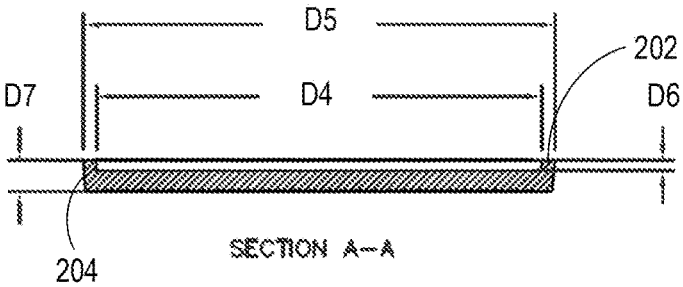
FIG. 7 is another cross-sectional view of the grate portion of FIG. 4.
Figure 8:
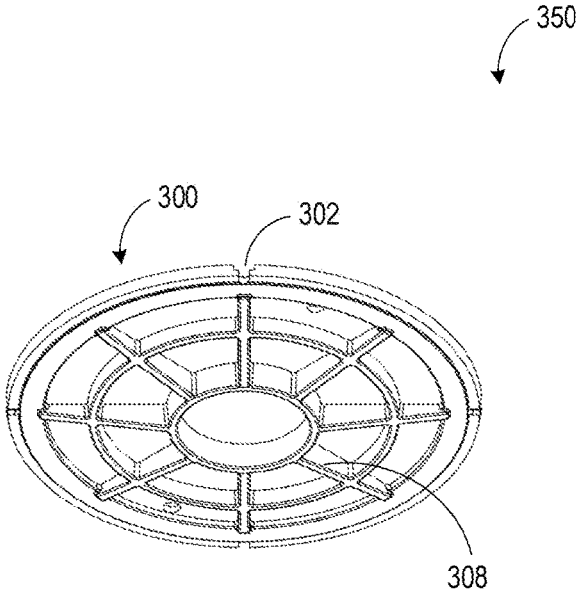
FIG. 8 is a bottom perspective view of a manhole cover, according to another particular embodiment.
Figure 9:
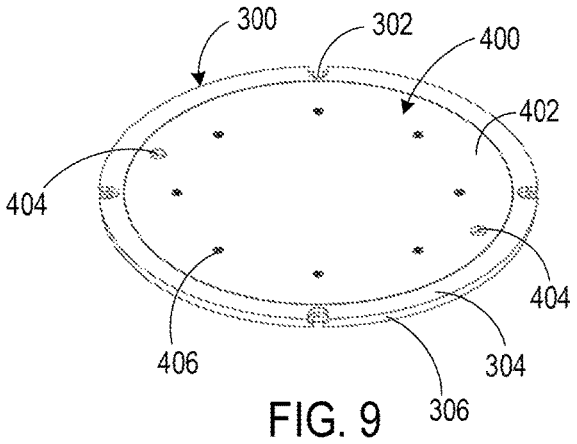
FIG. 9 is a top perspective view of the manhole cover of FIG. 8.

FIGS. 1-3 illustrate various views of a reinforced plastic composite portion 100 of an example manhole cover constructed according to a particular embodiment. The reinforced plastic composite portion 100 is configured to couple with a grate portion so as to form a manhole cover. In a particular embodiment, the grate portion is formed from cast iron. The reinforced plastic composite portion 100 includes apertures 104 and a reinforced plastic composite body 106 that includes a top surface 102 and a bottom surface 108. The reinforced plastic composite portion 100 is generally circular in shape and is configured to fit on top of, or within, a grate portion. In some embodiments, the reinforced plastic composite portion 100 may be rectangularly shaped so as to interface with similarly shaped manhole structures. The reinforced plastic composite portion 100 is configured to allow signals (e.g., radiofrequency signals, Wi-Fi signals, etc.) to pass through the reinforced plastic composite portion 100 so as to provide the ability to communicate data through the reinforced plastic composite portion 100. Accordingly, the reinforced plastic composite portion 100 is constructed from any material through which a wireless signal can pass. Examples of materials from which the reinforced plastic composite portion 100 is constructed include, but are not limited to, plastic, reinforced plastic, composite plastic, reinforced plastic composite, fiberglass, and thermoset plastic. In an example embodiment, the reinforced plastic composite portion 100 is constructed from a reinforced plastic composite of plastic and fiberglass. In other example embodiments, the reinforced plastic composite portion 100 may be constructed from combinations of other plastics to form additional composites. The composite material can provide both structural integrity (e.g., resistance to loads, explosion resistance, etc.) and the ability to allow a signal to pass through it. The reinforced plastic composite portion 100 is manufactured by any suitable method (e.g., casting, machining, etc.).

The reinforced plastic composite body 106 includes the top surface 102 and the bottom surface 108. The bottom surface 108 is sized and configured to interface with a grate portion (e.g., the grate portion 200) such that the top surface 102 covers the grate portion. The thickness of the reinforced plastic composite body 106 is represented by D3. In some embodiments, D3 is greater than or equal to 0.25 inches. In some embodiments, D3 is greater than or equal to 0.35 inches. In some arrangements, D3 is greater than or equal to 0.5 inches.

The apertures 104 are openings extending entirely through the reinforced plastic composite portion 100. As shown in FIG. 1, the reinforced plastic composite portion 100 includes four apertures 104; however, in various implementations the number of apertures 104 may be higher or lower. The apertures 104 are configured to receive fasteners (e.g., bolts, screws, rivets, etc.) such that the reinforced plastic composite portion 100 is coupled to a grate portion, where the grate portion includes openings to receive the fasteners. The distance between the apertures 104 is represented by D1 and D2. In some arrangements, D1 and D2 are substantially equal to each other such that the arrangement of the apertures 104 resembles a square. In some embodiments, the apertures 104 are arranged in other shapes such that D1 and D2 are not substantially equal to each other. In instances where there are more or less than four apertures 104, the apertures 104 are spaced substantially equidistantly.

FIGS. 4-7 illustrate various views of an example grate portion 200 for use with the reinforced plastic composite portion of FIGS. 1-3. The grate portion 200 is shown to include a lip 202, an intermediate portion 204, a recess 206, webbing 208, and openings 210. The grate portion 200 is generally circularly shaped and is sized and configured to rest on, or be nested in, a frame (not shown) of a manhole cover assembly. In some embodiments, the grate portion 200 may be rectangularly shaped so as to interface with similarly shaped manhole structures. The grate portion 200 is manufactured from cast gray or ductile iron and is manufactured using any manufacturing method suitable for manufacturing a grate portion of a manhole cover (e.g., casting, machining, etc.).

The lip 202 extends around the circumference of the grate portion 200 and defines a top surface of the grate portion 200. The recess 206 is defined by the space that extends from the top surface to the webbing 208. The webbing 208 includes a plurality of supports that extend across the grate portion 200 (thereby creating spaces between the plurality of supports) such that the grate portion 200 can support the reinforced plastic composite portion 100. The inner diameter of the lip 202 is represented by D4. In some arrangements, D4 is configured to receive the reinforced plastic composite portion 100. Accordingly, the diameter of the reinforced plastic composite portion 100 is approximately one eighth of an inch smaller than the inner diameter of the lip 202. The outer diameter of the lip 202 is represented by D5, and is configured to fit within the manhole.

The height of the recess 206 is represented by D6. The recess 206 is configured to receive the reinforced plastic composite portion 100 such that the lip 202 and the top surface 102 are substantially coplanar. The thickness 204 of the grate portion 200 is represented by D7.

The openings 210 extend entirely through the grate portion 200 and are configured to align with the apertures 104 of the reinforced plastic composite portion 100. Accordingly, the number of openings 210 and the arrangement thereof will match those of the apertures 104. The openings 210 are configured to receive the fasteners that extend through the apertures 104 such that the reinforced plastic composite portion 100 is coupled to the grate portion 200. In some embodiments, the reinforced plastic composite portion 100 is adhesively coupled to the grate portion 200 in addition to being coupled to the grate portion 200 via fasteners. In some embodiments, the reinforced plastic composite portion 100 is adhesively coupled to the grate portion 200 instead of being coupled to the grate portion 200 via fasteners.

When coupled, the combination of the reinforced plastic composite portion 100 and the grate portion 200 form a manhole cover. The manhole cover is configured to provide safety characteristics that comply with manhole cover safety standards. For example, the load bearing capacity for the manhole cover is sufficient to support the load of a vehicle located on top of the manhole cover. Furthermore, in some embodiments the manhole cover is able to resist being dislodged by an explosion. In addition, by including gaps within the grate portion 200, the manhole cover allows wireless signals to pass through via the reinforced plastic composite portion 100, providing for communications from beneath the manhole cover to reach receivers above the manhole cover. The manhole cover may also be lighter than a conventional manhole cover constructed entirely of cast iron, as a reinforced plastic composite hybrid material (e.g., cast iron and plastic) is lighter than cast iron alone. Accordingly, providing a lighter manhole cover can result in lower shipping costs, easier assembly and disassembly, and easier access when removing the manhole cover.

FIGS. 8-11 illustrate various views of a manhole cover 350, according to another embodiment. The manhole cover 350 includes a grate portion 300 and a reinforced plastic composite portion 400. The grate portion 300 includes bolt holes 302, a lip 304, an intermediate portion 306 extending away from the lip, a webbing 308, openings 310, and a recess 312. The reinforced plastic composite portion 400 includes lifting holes 404, apertures 406, and a body portion 408 that includes a top surface 402 and a bottom surface 410.

The grate portion 300 is generally circularly shaped and is sized and configured to rest on, or be nested in, a frame (not shown) of a manhole cover assembly. In some embodiments, the grate portion 300 may be rectangularly shaped so as to interface with similarly shaped manhole structures. The grate portion 300 is manufactured using cast gray or ductile iron and is manufactured using any manufacturing method suitable for manufacturing a grate portion of a manhole cover (e.g., casting, machining, etc.). The bolt holes 302 are positioned around the periphery of the grate portion 300 and extend through the lip 304. The bolt holes 302 are configured to receive fasteners (e.g., bolts, rivets, screws, etc.) such that the grate portion 300 is secured in place. As shown, the grate portion 300 includes four bolt holes 302; however, in some embodiments the grate portion 300 can include more or fewer than four bolt holes 302.

The lip 304 extends around the circumference of the grate portion 300 and defines a top surface of the grate portion 300. The recess 312 is defined by the space that extends from the top surface to the webbing 308. The webbing 308 includes a plurality of supports that extend across the grate portion 300 (thereby creating the openings 310) such that the grate portion 300 can support the reinforced plastic composite portion 400. The inner diameter of the lip 304 is represented by D9. The inner diameter of the lip 304 is configured to receive the reinforced plastic composite portion 400. Accordingly, the diameter of the reinforced plastic composite portion 400 (represented by D10) is approximately one eighth of an inch smaller than the inner diameter of the lip 304. The outer diameter of the lip 304 is represented by D8, and is configured to fit within the manhole.

In some embodiments, the recess 312 is configured to receive the reinforced plastic composite portion 400 such that the lip 304 and the top surface 402 are substantially coplanar. Accordingly, the thickness of the reinforced plastic composite portion 400 (represented by D12) is approximately equal to the height of the recess 312. The thickness 204 of the grate portion 200 is represented by D11.

The openings 310 extend entirely through the grate portion 300 and are configured to align with the apertures 406 of the reinforced plastic composite portion 400. Accordingly, the number of openings 310 and the arrangement thereof will match those of the apertures 406. The openings 310 are configured to receive fasteners (e.g., bolts, rivets, screws, etc.) that extend through the apertures 406 such that the reinforced plastic composite portion 400 is coupled to the grate portion 300 to create the manhole cover 350. In some embodiments, the reinforced plastic composite portion 400 is adhesively coupled to the grate portion 300 in addition to being coupled to the grate portion 300 via fasteners. In some embodiments, the reinforced plastic composite portion 400 is adhesively coupled to the grate portion 300 instead of being coupled to the grate portion 300 via fasteners.

The reinforced plastic composite portion 400 is generally circular in shape and is configured to fit on top of, or within, a grate portion (e.g., the grate portion 300). In some embodiments, the reinforced plastic composite portion 400 may be rectangularly shaped so as to interface with similarly shaped manhole structures. The reinforced plastic composite portion 400 is configured to allow signals (e.g., radiofrequency signals, Wi-Fi signals, etc.) to pass through the reinforced plastic composite portion 400 so as to provide the ability to communicate data through the reinforced plastic composite portion 400. Accordingly, the reinforced plastic composite portion 400 is constructed from any material through which a wireless signal can pass. Examples of materials from which the reinforced plastic composite portion 400 is constructed include, but are not limited to, plastic, reinforced plastic, composite plastic, reinforced plastic composite, fiberglass, and thermoset plastic. In an example embodiment, the reinforced plastic composite portion 400 is constructed from a reinforced plastic composite of plastic and fiberglass. In other example embodiments, the reinforced plastic composite portion 400 is constructed from combinations of other plastics to form additional reinforced plastic composites. The composite material can provide both structural integrity (e.g., resistance to loads, explosion resistance, etc.) and the ability to allow a signal to pass through it. The reinforced plastic composite portion 400 is manufactured by any suitable method (e.g., casting, machining, etc.).

The reinforced plastic composite body 408 includes the top surface 402 and the bottom surface 410. The bottom surface 410 is sized and configured to interface with the grate portion 300 such that the reinforced plastic composite portion 400 covers the grate portion 300. The thickness of the reinforced plastic composite body 408 is represented by D12. In some embodiments, D12 is greater than or equal to 0.25 inches. In some embodiments, D12 is greater than or equal to 0.35 inches. In some arrangements, D12 is greater than or equal to 0.5 inches including an acceptable tolerance (e.g., plus or minus 0.1 inches).

The lifting holes 404 are configured to receive a lifting tool that is used remove an assembly comprising the plastic composite portion 400 and the grate portion 300 from a manhole frame. As shown, the reinforced plastic composite portion 400 includes two lifting holes 404; however, in some embodiments the reinforced plastic composite portion 400 may include more or less than two lifting holes 404.

Figure 10:
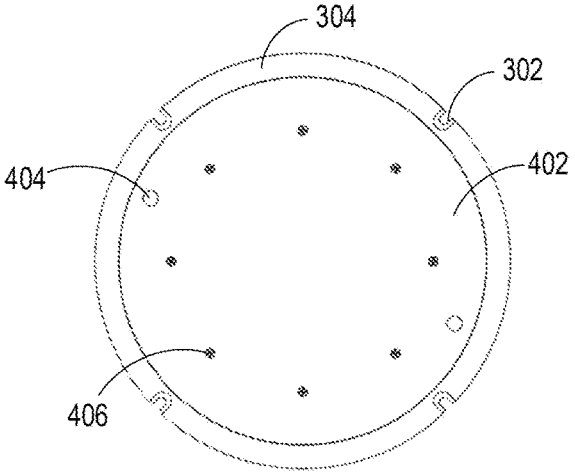
FIG. 10 is a top view of the manhole cover of FIG. 8.
Figure 11:
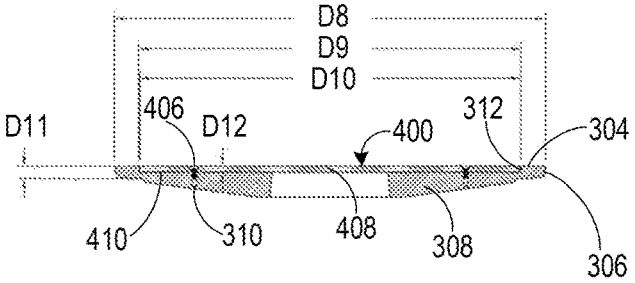
FIG. 11 is a cross-sectional view of the manhole cover of FIG. 8.
Figure 12:
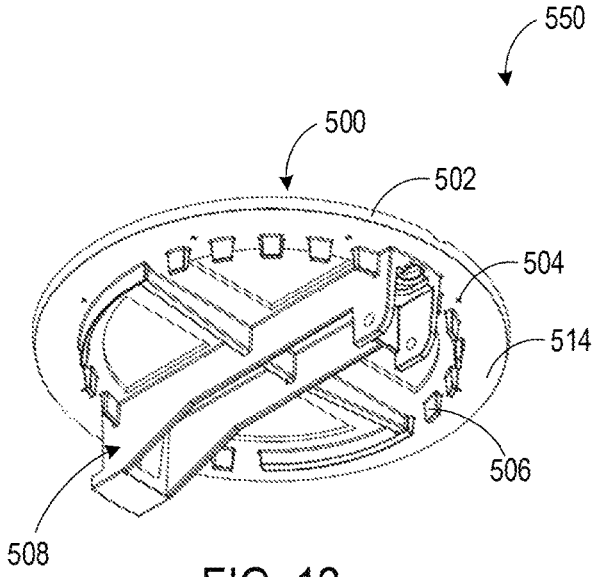
FIG. 12 is a bottom perspective view of another manhole cover, according to still another embodiment.

The apertures 406 are openings extending entirely through the reinforced plastic composite portion 400. As shown in FIG. 10, the reinforced plastic composite portion 400 includes eight apertures 406; however, in various implementations the number of apertures 406 may be higher or lower. The apertures 406 are configured to receive fasteners (e.g., bolts, screws, rivets, etc.) such that the reinforced plastic composite portion 400 is coupled to the grate portion 300 via the openings 310. In some arrangements, the distances between the apertures 406 are substantially equal to each other such that the arrangement of the apertures 406 resembles a circle. In some embodiments, the apertures 406 are arranged in other shapes such that distances between the apertures 406 are not substantially equal to each other.

The manhole cover 350 is configured to provide safety characteristics that comply with manhole safety standards. For example, the load bearing capacity for the manhole cover 350 is sufficient to support the load of a vehicle located on top of the manhole cover 350. Furthermore, in some embodiments the manhole cover 350 is able to resist being dislodged by an explosion. In addition, the manhole cover 350 allows wireless signals to pass through via the reinforced plastic composite portion 400, providing for communications from beneath the manhole cover 350 to reach receivers above the manhole cover 350. The manhole cover 350 may also be lighter than a conventional manhole cover constructed entirely of cast iron, as a reinforced plastic composite hybrid (e.g., cast iron and plastic) is lighter than cast iron alone. Accordingly, providing the manhole cover 350 that is lighter than a conventional manhole cover can result in lower shipping costs, easier assembly and disassembly, and easier access when removing the manhole cover.

FIGS. 12-15 illustrate various views of a manhole cover 550, according to still another embodiment. The manhole cover 550 includes a grate portion 500 and a reinforced plastic composite portion 600. The grate portion 500 includes openings 504, ribs 506, a locking mechanism 508, a lip 510, a recess 512, a bottom surface 514, and an intermediate portion 502 positioned between the lip 510 and the bottom surface 514. The reinforced plastic composite portion 600 includes apertures 604, lifting holes 606, a cutout 608, and a reinforced plastic composite body 610 that includes a top surface 602 and a bottom surface 612.

The grate portion 500 is generally circularly shaped and is sized and configured to rest on, or be nested in, a frame (not shown) of a manhole cover assembly. In some embodiments, the grate portion 500 may be rectangularly shaped so as to interface with similarly shaped manhole structures. The grate portion 500 is manufactured from cast gray or ductile iron, and is manufactured using any manufacturing method suitable for manufacturing a grate portion of a manhole cover (e.g., casting, machining, etc.).

The lip 510 extends around the circumference of the grate portion 500 and defines a top surface of the grate portion 500. The recess 512 is defined by the space that extends from the top surface to the locking mechanism 508. The recess 512 is configured to receive the reinforced plastic composite portion 600 such that the lip 510 and the top surface 602 are substantially coplanar. The inner diameter of the lip 510 is represented by D14. The inner diameter of the lip 510 is configured to receive the composite portion 600. Accordingly, the diameter of the reinforced plastic composite portion 600 (represented by D15) is approximately one eighth of an inch smaller than the inner diameter of the lip 510. The outer diameter of the lip 510 is represented by D13, and is configured to fit within the manhole. The intermediate portion 502 of the grate portion 500 extends from the lip 510 to the bottom surface 514, and is represented by D16.

The openings 504 extend entirely through the grate portion 500 and are configured to align with the apertures 604 of the reinforced plastic composite portion 600. Accordingly, the number of openings 504 and the arrangement thereof will match those of the apertures 604. The openings 504 are configured to receive fasteners (e.g., bolts, rivets, screws, etc.) that extend through the apertures 604 such that the reinforced plastic composite portion 600 is coupled to the grate portion 500 to create the manhole cover 550. In some embodiments, the reinforced plastic composite portion 600 is adhesively coupled to the grate portion 500 in addition to being coupled to the grate portion 500 via fasteners. In some embodiments, the reinforced plastic composite portion 600 is adhesively coupled to the grate portion 500 instead of being coupled to the grate portion 500 via fasteners.

The ribs 506 extend downward from the bottom surface 514 and are configured to direct pressurized air away from the grate portion 500 in instances where an explosion may occur. The locking mechanism 508 extends from the bottom surface 514 and is configured to allow the grate portion 500 to move upward in the event of an explosion, but prevent the grate portion 500 from being thrown in to the air by an explosive force. The locking mechanism 508 allows the grate portion 500 to move upward enough to expose the ribs 506 such that the ribs can direct pressurized air as described.

The reinforced plastic composite portion 600 is generally circular in shape and is configured to fit on top of, or within, a grate portion (e.g., the grate portion 500). In some embodiments, the reinforced plastic composite portion 600 may be rectangularly shaped so as to interface with similarly shaped manhole structures. The reinforced plastic composite portion 600 is configured to allow signals (e.g., radiofrequency signals, Wi-Fi signals, etc.) to pass through the reinforced plastic composite portion 600 so as to provide the ability to communicate data through the reinforced plastic composite portion 600. Accordingly, the reinforced plastic composite portion 600 is constructed from any material through which a wireless signal can pass. Examples of materials from which the reinforced plastic composite portion 600 is constructed include, but are not limited to, plastic, reinforced plastic, composite plastic, reinforced plastic composite, fiberglass, and thermoset plastic. In an example embodiment, the reinforced plastic composite portion 600 is constructed from a composite of plastic and fiberglass. In other example embodiments, the reinforced plastic composite portion 600 is constructed from combinations of other plastics to form additional reinforced plastic composites. The composite material can provide both structural integrity (e.g., resistance to loads, explosion resistance, etc.) and the ability to allow a signal to pass through it. The reinforced plastic composite portion 600 is manufactured by any suitable method (e.g., casting, machining, etc.).

The reinforced plastic composite body 610 includes the top surface 602 and the bottom surface 612. The bottom surface 612 is sized and configured to interface with the grate portion 500 such that the reinforced plastic composite portion 600 covers the grate portion 500. The thickness of the reinforced plastic composite body 610 is represented by D17. In some embodiments, D17 is greater than 0.25 inches. In some embodiments, D17 is greater than 0.35 inches. In some arrangements, D17 is greater than 0.5 inches including an acceptable tolerance (e.g., plus or minus 0.1 inches).

The lifting hole 606 is configured to receive a lifting tool that is used to pry the reinforced plastic composite portion 600 from the grate portion 500. As shown, the reinforced plastic composite portion 600 includes one lifting hole 606; however, in some embodiments the reinforced plastic composite portion 600 may include more than one lifting hole 606.

Figure 13:
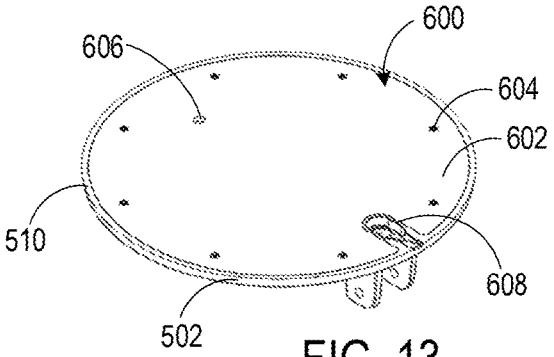
FIG. 13 is a top perspective view of the manhole cover of FIG. 12.
Figure 14:
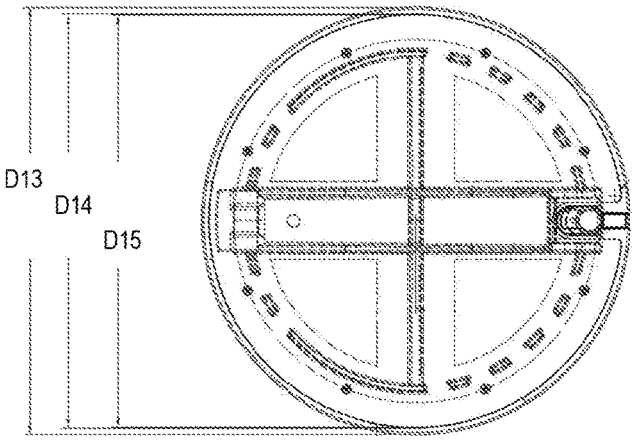
FIG. 14 is a top view of the manhole cover of FIG. 12.
Figure 15:
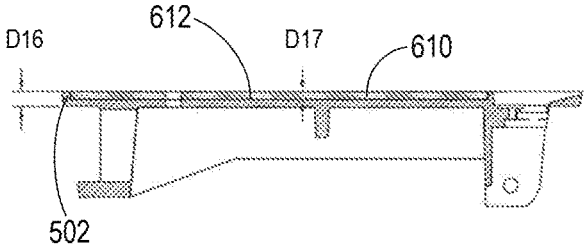
FIG. 15 is a cross-sectional view of the manhole cover of FIG. 12.

The apertures 604 are openings extending entirely through the reinforced plastic composite portion 600. As shown in FIG. 13, the reinforced plastic composite portion 600 includes eight apertures 604; however, in various implementations the number of apertures 604 may be higher or lower. The apertures 604 are configured to receive fasteners (e.g., bolts, screws, rivets, etc.) such that the reinforced plastic composite portion 600 is coupled to the grate portion 500 via the openings 504. In some arrangements, the distances between the apertures 604 are substantially equal to each other such that the arrangement of the apertures 604 resembles a circle. In some embodiments, the apertures 604 are arranged in other shapes such that distances between the apertures 604 are not substantially equal to each other.

The manhole cover 550 is configured to provide safety characteristics that comply with manhole safety standards. For example, the load bearing capacity for the manhole cover 550 is sufficient to support the load of a vehicle located on top of the manhole cover 550. Furthermore, the manhole cover 550 is able to resist being dislodged by an explosion. In addition, the manhole cover 550 allows wireless signals to pass through via the reinforced plastic composite portion 600, providing for communications from beneath the manhole cover 550 to reach receivers above the manhole cover 550. The manhole cover 550 may also be lighter than a conventional manhole cover constructed entirely of cast iron, as a reinforced plastic composite material (e.g., cast iron and plastic) is lighter than cast iron alone. Accordingly, providing the manhole cover 550 that is lighter than a conventional manhole cover can result in lower shipping costs, easier assembly and disassembly, and easier access when removing the manhole cover.

Various tests have been conducted on a manhole cover including a reinforced plastic composite portion (e.g., the reinforced plastic composite portion 100, the reinforced plastic composite portion 400, the reinforced plastic composite portion 600, etc.) and a grate portion (e.g., the grate portion 200, the grate portion 300, the grate portion 500, etc.) to determine the performance characteristics (e.g., the performance of the manhole cover under H-25 loading). For example, to determine the amount of deformation under load, a 50,000 pound weight was applied to the manhole cover for approximately one minute. After the load was removed from the manhole cover, it was determined that the manhole cover deformed by approximately 0.147 inches. The precise amount of deformation can vary depending on system requirements and/or standards.

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the terms "substantially," "approximately," and similar terms are intended to cover the value stated in the disclosure plus or minus ten percent. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The term "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the application, the scope being defined by the claims that follow. When the language a "portion" is used, the item can include a portion and/or the entire item unless specifically stated to the contrary.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Although only a few embodiments have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter described herein. For example, elements shown as integrally formed may be constructed of multiple components or elements, the position of elements may be reversed or otherwise varied, and the nature or number of discrete elements or positions may be altered or varied. The order or sequence of any method processes may be varied or resequenced according to alternative embodiments. Other substitutions, modifications, changes, and omissions may also be made in the design, operating conditions and arrangement of the various exemplary embodiments without departing from the scope of the present invention.

What is claimed is:

1. A manhole cover, comprising:

a base comprising:

a grate portion, the grate portion defining at least one opening extending therethrough; and a lip integrally formed with and extending axially from the grate portion along an outer circumference thereof, the grate portion and the lip defining a recess therein; and a composite portion comprising a composite material, the composite portion comprising:

a composite body including a top surface and a bottom surface;

at least one aperture extending through the composite body, the top surface, and the bottom surface, the at least one aperture configured to receive at least one fastener, the at least one aperture configured to align with the at least one opening;

wherein the composite portion is configured to fit within the recess.

2. The manhole cover of claim 1, wherein the composite material comprises a combination of plastic and fiberglass.

3. The manhole cover of claim 2, wherein the composite material is constructed of a material that permits wireless signals to pass therethrough.

4. The manhole cover of claim 1, wherein the at least one fastener couples the composite portion to the grate portion.

5. The manhole cover of claim 4, wherein the composite portion is coupled to the grate portion with an adhesive.

6. The manhole cover of claim 1, wherein the composite material comprises a reinforced plastic.

7. The manhole cover of claim 6, wherein the composite material comprises a carbon fiber reinforced polymer.

8. The manhole cover of claim 6, wherein the composite material comprises an aramid fiber reinforced polymer.

9. The manhole cover of claim 1, wherein the grate portion is formed from cast iron.

10. A manhole cover, comprising:

a base comprising a grate portion; and a lip integrally formed with and extending axially from the grate portion along an outer circumference thereof, the grate portion and the lip defining a recess therein; and a composite portion removably coupled to the base and comprising a composite material, the composite portion comprising:

a composite body including a top surface and a bottom surface, the composite body defining at least one aperture extending entirely therethrough, the at least one aperture configured to receive at least one fastener configured to align with an opening in the grate portion;

wherein the composite portion is configured to fit within the recess.

11. The manhole cover of claim 10, wherein the composite material comprises a combination of plastic and fiberglass.

12. The manhole cover of claim 11, wherein the composite material is constructed of a material that permits wireless signals to pass therethrough.

13. The manhole cover of claim 12, wherein the wireless signals pass through the grate portion to reach the composite portion.

14. The manhole cover of claim 10, wherein the at least one fastener couples the composite portion to the grate portion.

15. The manhole cover of claim 10, wherein the composite material comprises a reinforced plastic.

16. The manhole cover of claim 15, wherein the composite material comprises a carbon fiber reinforced polymer.

17. The manhole cover of claim 15, wherein the composite material comprises an aramid fiber reinforced polymer.

18. A manhole cover configured to couple with a manhole frame, the manhole cover comprising:

a base configured to couple with the manhole frame, the base comprising:

a grate portion defining a plurality of spaces therein, the grate portion further defining at least one opening extending therethrough; and a lip integrally formed with and extending axially from the grate portion along an outer circumference thereof, the base and the lip defining a recess therein; and a composite portion comprising a composite material, the composite portion comprising:

a composite body including a top surface and a bottom surface; and at least one aperture extending through the composite body, the top surface, and the bottom surface, the at least one aperture configured to receive at least one fastener, the at least one aperture configured to align with the at least one opening;

wherein the composite portion is configured to fit within the recess.

19. The manhole cover of claim 18, wherein the composite material comprises a combination of plastic and fiberglass.

20. The manhole cover of claim 19, wherein the composite material is constructed of a material that permits wireless signals to pass therethrough.

* * * * *